United States Patent [19]

Ohe et al.

[11] Patent Number: 4,717,922

[45] Date of Patent: Jan. 5, 1988

[54] AUTOMOBILE ANTENNA SYSTEM

[75] Inventors: Junzo Ohe; Hiroshi Kondo, both of Aichi, Japan

[73] Assignee: Toyota Jidosha Kabushiki Kaisha, Toyota, Japan

[21] Appl. No.: 794,848

[22] Filed: Nov. 4, 1985

[30] Foreign Application Priority Data

Nov. 6, 1984 [JP] Japan ..... 59-234360
Nov. 28, 1984 [JP] Japan ..... 59-252233

[51] Int. Cl.[4] ..... H01Q 1/27; H01Q 7/04; H01Q 1/32; H01Q 1/48

[52] U.S. Cl. ..... 343/712; 343/713; 343/714; 343/741; 343/744; 343/841; 343/866

[58] Field of Search ..... 343/705, 872-873, 343/708-710, 851, 711-718, 726, 728, 741-745, 748, 841, 842, 866, 702, 867, 907, 908, 904, 905; 455/19, 41, 82, 99, 129, 269-280, 345

[56] References Cited

U.S. PATENT DOCUMENTS

| | | | |
|---|---|---|---|
| 2,200,674 | 5/1940 | McDonald, Jr. | 343/866 |
| 2,212,253 | 8/1940 | Stief | 343/715 |
| 2,404,093 | 7/1946 | Roberts | 343/708 |
| 2,481,978 | 9/1949 | Clough | 343/712 |
| 2,520,986 | 9/1950 | Williams | 343/867 X |
| 2,575,471 | 11/1951 | Schweiss | 343/712 |
| 2,740,113 | 3/1956 | Hemphill | 343/787 |
| 2,774,811 | 12/1956 | Shanok et al. | 343/711 |
| 2,859,441 | 11/1958 | Rosenbaum | 343/712 |
| 2,950,479 | 8/1960 | Pan | 343/866 X |

(List continued on next page.)

FOREIGN PATENT DOCUMENTS

| | | | |
|---|---|---|---|
| 0181120 | 5/1986 | European Pat. Off. . | |
| 0181200 | 5/1986 | European Pat. Off. . | |
| 0181765 | 5/1986 | European Pat. Off. . | |
| 0182497 | 5/1986 | European Pat. Off. . | |
| 0183523 | 6/1986 | European Pat. Off. . | |
| 0183520 | 6/1986 | European Pat. Off. . | |
| 0183443 | 6/1986 | European Pat. Off. . | |
| 889618 | 9/1953 | Fed. Rep. of Germany . | |
| 1131762 | 6/1962 | Fed. Rep. of Germany . | |
| 1949828 | 4/1970 | Fed. Rep. of Germany . | |
| 7015306 | 9/1970 | Fed. Rep. of Germany . | |
| 2425189 | 12/1974 | Fed. Rep. of Germany . | |
| 2701921 | 7/1978 | Fed. Rep. of Germany . | |
| 2745475 | 4/1979 | Fed. Rep. of Germany . | |
| 2821202 | 11/1979 | Fed. Rep. of Germany . | |
| 2733478 | 4/1980 | Fed. Rep. of Germany . | |
| 53-22418 | 7/1978 | Japan . | |
| 53-34826 | 8/1978 | Japan . | |
| 0046617 | 4/1980 | Japan | 343/712 |
| 129464 | 2/1984 | Japan . | |
| 59-44861 | 3/1984 | Japan . | |

OTHER PUBLICATIONS

Japanese Pat. Abstract, vol. 6, No. 37 E-97, Mar. 6, 1982, 56-156031.

Japanese Pat. Abstract, vol. 6, No. 55 E-101, 4/10/82, 56-168441.

Japanese Pat. Abstract, vol. 7, No. E-187, 7/15/53, 58-70640.

Japanese Pat. Abstract, vol. 7, No. 162 E-187, 7/15/83, 58-70642.

*Primary Examiner*—Marvin L. Nussbaum

*Attorney, Agent, or Firm*—Cushman, Darby & Cushman

[57] ABSTRACT

The present invention provides an automobile antenna system for detecting surface currents induced on the vehicle body by radio waves. The antenna system includes an electrostatic shielding case mounted on the vehicle body and having an opening formed therein. The opening in the case faces a metallic plate in the vehicle body and a loop antenna is housed within the case and disposed in close proximity to the opening thereof. The loop antenna has a plane of the loop positioned relative to the surface of the metallic vehicle plate at an angle in the range of 90 degrees to 135 degrees or 225 degrees to 270 degrees, whereby the antenna system can more efficiently detect the surface currents induced on the vehicle body by radio waves and can be miniaturized and improved in performance without any externally protruding member.

12 Claims, 9 Drawing Figures

U.S. PATENT DOCUMENTS

| | | | |
|---|---|---|---|
| 2,971,191 | 2/1961 | Davis | 343/712 |
| 3,007,164 | 10/1961 | Davis | 343/712 |
| 3,066,293 | 11/1962 | Davis | 343/767 |
| 3,210,766 | 10/1965 | Parker | 343/743 |
| 3,364,487 | 1/1968 | Maheux | 343/702 |
| 3,611,388 | 10/1971 | Okumura | 343/712 |
| 3,717,876 | 2/1973 | Volkers et al. | 343/712 |
| 3,728,732 | 4/1973 | Igarashi | 343/713 |
| 3,742,508 | 6/1973 | Tomaszewski | 343/713 |
| 3,794,997 | 2/1974 | Iwatsuki et al. | 343/712 |
| 3,823,403 | 7/1974 | Walter et al. | 343/745 X |
| 3,916,413 | 10/1975 | Davis | 343/712 |
| 3,961,292 | 6/1976 | Davis | 343/712 |
| 3,961,330 | 6/1976 | Davis | 343/712 |
| 3,972,048 | 7/1976 | Davis | 343/711 |
| 4,003,056 | 6/1977 | Davis | 343/713 X |
| 4,080,603 | 3/1978 | Moody | 343/712 |
| 4,217,591 | 8/1980 | Czerwinski | 343/713 |
| 4,278,980 | 7/1981 | Ogita et al. | 343/748 |
| 4,317,121 | 2/1982 | Allen, Jr. et al. | 343/712 |
| 4,339,827 | 7/1982 | Torres et al. | 343/748 X |
| 4,499,606 | 2/1985 | Rambo | 455/277 |
| 4,506,267 | 3/1985 | Harmuth | 343/744 |
| 4,566,133 | 1/1986 | Rambo | 455/277 |
| 4,633,519 | 12/1986 | Gotoh et al. | 455/277 |

AUTOMOBILE ANTENNA SYSTEM

BACKGROUND OF THE INVENTION

1. Field of the Invention

The present invention relates to an improved automobile antenna system for effectively detecting radio waves received by the vehicle body and transmitting the detected signals to various built-in receivers.

2. Description of the Prior Art

In modern automobiles, it is essential to have antenna systems for positively receiving various broadcast (radio and TV) or communications (car-telephone and others) waves at their built-in receivers. Moreover, such antenna systems also are important, for example, for citizen band tranceivers which are adapted to effect the transmission and reception of waves between the automobile and other stations.

In the prior art, there is generally known a pole type antenna which projects outwardly from the vehicle body and has a preferable performance of reception.

However, such a pole type antenna is actually subject to being damaged or stolen and also produces an unpleasant noise when an automobile on which the pole type antenna is mounted runs at high speeds. It has been desired to eliminate such a pole type antenna from the vehicle body.

In recent years, frequency bands of radio or communication waves to be received at vehicles are being increased so as to require a plurality of antenna systems accommodating various frequency bands. This not only degrades the aesthetics of the vehicle, but also reduces reception performance due to electrical interference between the antennas.

SUMMARY OF THE INVENTION

It is therefore an object of the present invention to provide an automobile antenna system having a compact construction and improved performance and having no outwardly projecting or exposed element.

For this end, the present invention provides an automobile antenna system comprising an electrostatic shielding case mounted on the vehicle body and having an opening formed therein opposed to a metallic plate of the vehicle body and a loop antenna disposed adjacent and opposed to the opening in the case.

The present invention is characterized in that the loop antenna has the plane of the loop positioned relative to the vehicle metallic plate at an angle in the range of 90 degrees to 135 degrees or 225 degrees to 270 degrees, the loop antenna being adapted to detect surface currents induced on the vehicle body by electromagnetic waves i.e. radio or communication waves and so on.

Within the aforementioned range of angles, the relative inclination between the loop antenna and the plane of the metallic vehicle plate is determined such that the loop antenna can most efficiently detect the surface currents on the metallic vehicle plate.

When surface currents are formed on the metallic plate of the vehicle body by, for example, radio waves, there is created a magnetic field which is in turn is picked up by the loop antenna housed in the electrostatic shielding case so that good reception of the waves can be accomplished by the antenna system.

DETAILED DESCRIPTION OF PREFERRED EMBODIMENTS

Figure 2:
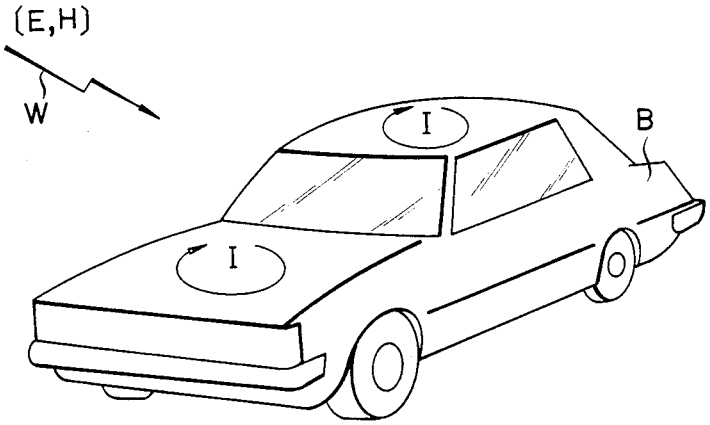
FIG. 2 illustrates surface currents I induced on a vehicle body B by external high-frequency waves W.

Referring to FIG. 2, there are shown surface currents I induced on a vehicle body B, made of conductive metal, by external waves W such as radio waves and others when passed through the vehicle body, the intensity of the induced surface currents corresponding to that of the external waves. The present invention provides an automobile antenna system as shown in FIG. 3, which can pickup such surface currents induced on the vehicle body by the external waves.

FIRST EMBODIMENT

Figure 3:
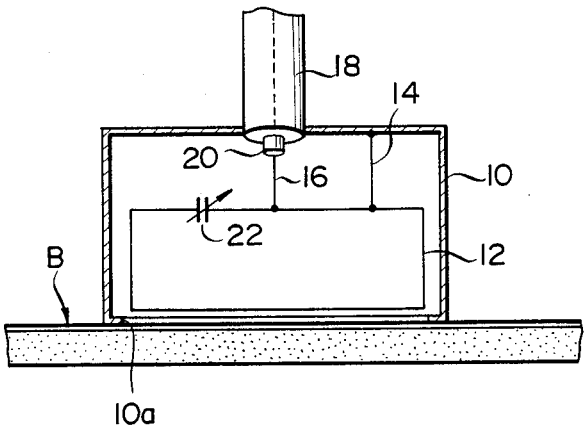
FIG. 3 illustrates the details of the automobile antenna system according to the present invention.

Referring to FIG. 3, an automobile antenna system, which is the first embodiment of the present invention, comprises an electrostatic shielding case 10 of electrically conductive material and a loop antenna 12 fixedly mounted within the shielding case 10 such that any external wave can be prevented from penetrating into the loop antenna except along a predetermined path. The shielding case 10 includes an opening 10a formed therein through which a portion of the loop antenna 12 is externally exposed. The exposed portion of the loop antenna 12 is positioned in close proximity to the surface of the vehicle body B to detect a magnetic field induced by the surface currents on the vehicle body.

The loop antenna 12 is electrically connected with the shielding case 10 through a short-circuiting line 14. The output line 16 of the loop antenna 12 is electrically connected with a conductor 20 in a coaxial cable 18. The loop antenna 12 further includes a capacitor 22 which can cause the frequency of the loop antenna 12 to resonate with a desired frequency to be measured to increase the efficiency in picking-up.

In such an arrangement, the magnetic field formed by the surface high-frequency currents induced on the vehicle body by radio waves can positively be caught by the loop antenna 12. Since the loop antenna 12 is positively shielded from any external field by the shielding case 10, only the surface currents induced on the vehicle body can efficiently be detected by the loop antenna 12 with improved sensitivity.

Such detected signals are supplied to various built-in receivers through the coaxial cable 18 via any external instruments such as a voltage amplifier and other (not shown).

Figure 5:
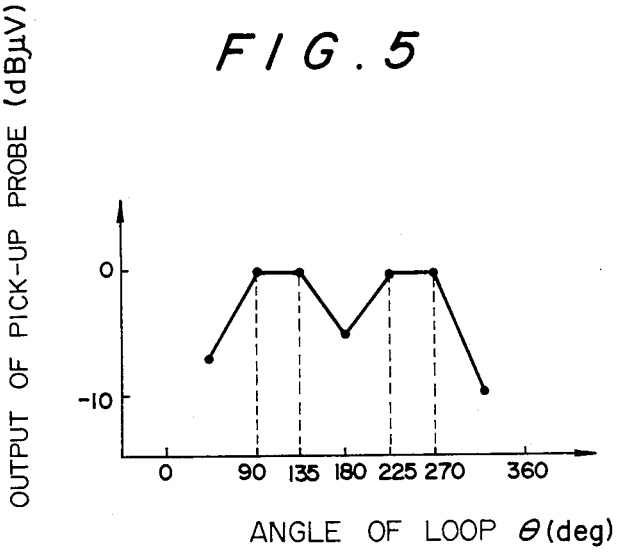
FIG. 5 is a graph showing the results obtained by the investigation of FIG. 4.

The inventors discovered that the detection efficiency highly depended on angles included between the plane of the loop in the loop antenna 12 and the plane of a metallic plate in the vehicle body B to which the loop antenna 12 is faced. Experiments as shown in FIG. 5 have thus been carried out to determine an optimum angle with which the loop antenna is mounted on the vehicle body.

Figure 4:
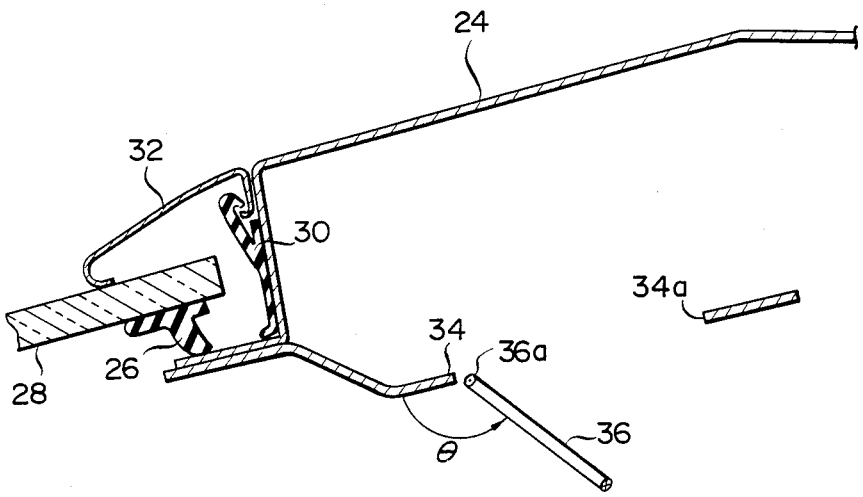
FIG. 4 is a view illustrating a manner of experiment which investigates the relationship between the relative inclination of the metallic vehicle plate and loop antenna and the detection efficiency of surface currents.

In FIG. 4, a roof panel 24 has its rear edge connected with a rear window glass 28 through a sealing dam 27. As is well-known, the marginal edge of the rear window glass 28 is covered by a molding 32 which is in turn mounted at one side margin on a stopper 30 fixed to the roof panel 24.

The roof panel 24 includes an inwardly extending roof rim bar 34 having an opening 34*a*. The present invention is directed to an automobile antenna system disposed in the roof rim bar 34 at the opening 34*a*. A pick-up probe 36 constructed and functioning in the same manner as in the loop antenna 12 shown in FIG. 3 is used to determine an optimum mounting angle with which the loop antenna 12 is most efficiently positioned relative to the surface of the roof rim bar 34.

As seen from FIG. 4, the pick-up end 36*a* of the pick-up probe 36 is used to position in close proximity to the edge of the roof rim bar opening 34*a* and also to move in such a manner that the pick-up probe 36 is positioned relative to the plan of the roof rim bar 34 with various different angles therebetween. At each of these angles $\theta$, the detection efficiency of the pick-up probe 36 is determined relative to surface currents flowing in the roof rim bar 34.

FIG. 5 shows the results from the above investigations. As seen from FIG. 5, the detection efficiency has peak levels when the pick-up probe 36 is positioned relative to the plane of the roof rim bar 34 with an angle in the range of 90 degrees to 135 degrees and 225 degrees to 270 degrees.

Therefore, if the loop antenna 12 has its plane of the loop positioned relative to the plane of the roof rim bar 34 with an angle in the range of 90 degrees to 135 degrees and 225 degrees to 270 degrees, the automobile antenna system can very efficiently detect surface currents on the vehicle body.

Similar results have been obtained with respect to the engine hood, trunk lid and other locations at which the automobile antenna system of the present invention can be mounted on the vehicle body.

The present invention is based on the results in the experiments mentioned above.

Figure 1:
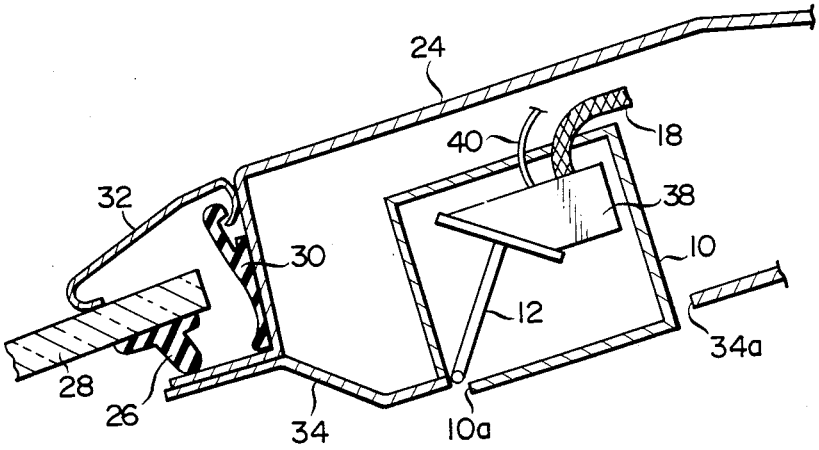
FIG. 1 is a cross-sectional view of the first embodiment of an automobile antenna system constructed in accordance with the present invention, the antenna system being mounted on a roof rim bar on the vehicle body.

Referring now to be FIG. 1, there is shown the first embodiment of the automobile antenna system according to the present invention, which is mounted in the roof panel 24 at the roof rim bar 34. In FIG. 1, parts similar to those of FIG. 4 are designated by similar reference numerals.

To position the loop antenna 12 of the automobile antenna system relative to the roof rim bar 34, the latter is provided with an opening 34*a* through which the electrostatic shielding case 10 of the automobile antenna system is inserted into the roof panel 24.

The shielding case 10 includes an opening 10*a* through which one longer side of the loop antenna 12 is externally exposed. The exposed portion of the loop antenna 12 will be thus positioned in close proximity to the opening edge of the roof rim bar 34, In the illustrated embodiment, the present invention is characterized in that the loop antenna 12 is positioned relative to the plane of the roof rim bar 34 with an angle $\theta$ equal to 225 degrees. As seen from FIG. 5, such an angle makes the detection efficiency of surface currents higher and yet contributes to the reduction of height in the shielding case 10. Therefore, the shielding case 10 can entirely be embedded between the roof panel 24 and the roof rim bar 34.

In such a manner, a magnetic flux induced by surface currents flowing on and along the marginal edge of the roof rim bar 34 can very efficiently and positively be caught by the loop antenna 12 within the shielding case 10. The sensitivity can also be increased since the loop antenna 12 is positively protected from any other external waves by the shielding case 10.

The shielding case 10 also contains a circuit section 38 connected with the loop antenna 12. The circuit section 38 includes means for processing detected signals from the loop antenna 12, such as a pre-amplifier and others. The detected and processed signals are supplied to various built-in receivers through the coaxial cable 18 via a voltage amplifier and others.

The circuit section 38 receives power and control signals through a cable 40.

SECOND EMBODIMENT

As previously described, the inventors discovered that the detection efficiency of surface currents highly depended on angles with which the plane of the loop in the loop antenna 12 is positioned relative to the marginal edge of a metallic plate in the vehicle body B. Experiments shown in FIG. 8 were then carried out to determine an optimum angle with which th marginal edge of the metallic vehicle plate is to be turned relative to the loop antenna.

Figure 8:
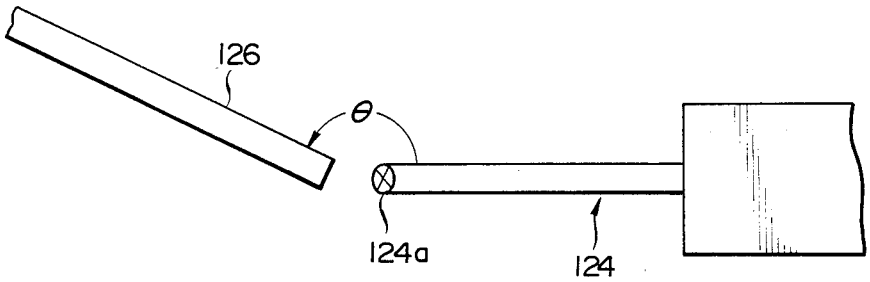
FIG. 8 is a view illustrating a manner of experiment which investigates the dependency between the relative inclination of the metallic vehicle plate and loop antenna and the detection efficiency of surface currents.

In FIG. 8, the above optimum angle is determined by the use of a pick-up probe 124 constructed and functioning in the same manner as the loop antenna 12 shown in FIG. 3, the pick-up end 124*a* being positioned in close proximity to the marginal edge of the metallic plate 126 of the vehicle body.

In such a position, the angle of the pick-up probe 124 relative to the metallic plate 126 is variously changed to determine the efficiency of the pick-up probe 124 detecting the surface currents in the metallic plate 126 at each of various angles $\theta$.

Figure 9:
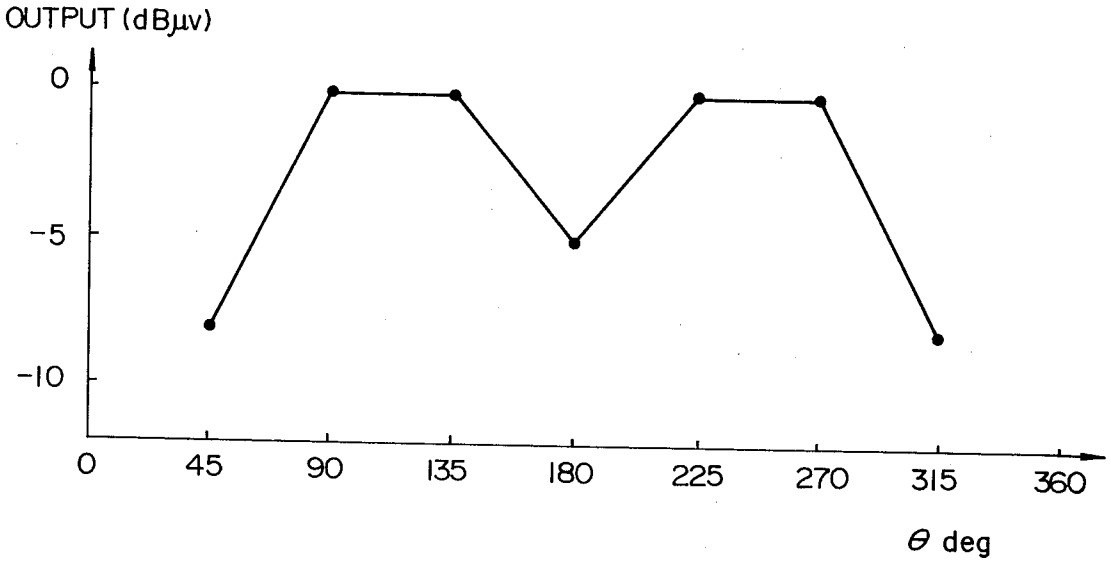
FIG. 9 is a graph showing the results obtained from the experiment of FIG. 8.

FIG. 9 shows the results from the experiments mentioned above. As seen from FIG. 9, the detection efficiency of surface currents is very increased when the plane of the loop in the loop antenna 124 is positioned relative to the plane of the metallic plate 126 with an angle in the range of 90 degrees to 135 degrees and 225 degrees to 270 degrees.

It is thus understood that surface currents on the vehicle body can very efficiently be detected by the loop antenna if the marginal edge of the metallic vehicle plate is turned toward the plane of the loop in the loop antenna to include an angle in the range of 90 degrees to 135 degrees or 225 degrees to 270 degrees.

Figure 6:
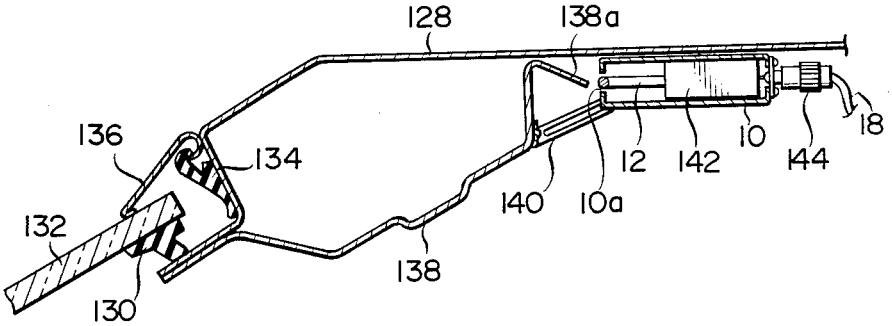
FIG. 6 is a cross-sectional view of the second embodiment of the automobile antenna system according to the present invention, which is mounted on a roof rim bar on the vehicle body.
Figure 7:
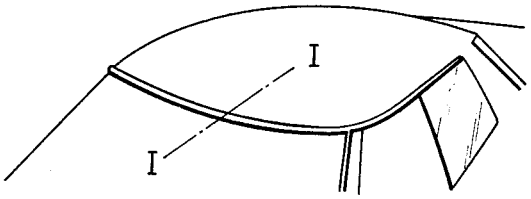
FIG. 7 is a view showing the position of the sectioned portion of the vehicle body illustrated in FIG. 6.

In view of the above results, the present invention provides the second embodiment thereof shown in FIGS. 6 and 7.

FIG. 6 is a cross-sectional view of the vehicle roof taken along a line I—I in FIG. 7.

In FIG. 6, a windshield glass 132 is connected with the front margin of a roof panel 128 through a sealing dam 130. As is well-known, the marginal edge of the windshield glass 132 is covered by a molding 136 which is fixedly mounted at one edge on a stopper 134 attached to the roof panel 128.

A roof rim bar 138 is positioned inside the roof panel 128, the marginal edge of the roof rim bar 138 on the side of the windshield glass being joined to the roof panel 128 as by spot-welding. Thus, surface currents induced on the roof panel 128 by radio waves can be directly transmitted or diffracted to the roof rim bar 138.

The second embodiment is of substantially the same construction as that of the first embodiment and comprises an electrostatic shielding case 10 and a loop antenna 12 housed within the shielding case 10. The shielding case 10 includes an opening 10*a* formed therein through which one longer side of the loop antenna 12 is externally exposed. The exposed portion of the loop antenna 12 is positioned in close proximity to the marginal edge of the roof rim bar 138.

The electrostatic shielding case 10 is preferably mounted on the vehicle body by means of an adjustable bracket 140.

The second embodiment is characterized in that the marginal edge 138*a* of the roof rim bar 138 is turned relative to the plane of the loop in the loop antenna 12 with an angle equal to 135 degrees, which is one of the optimum angles $\theta$ as shown in FIG. 9. Thus, the automobile antenna system can be mounted on such a location of the vehicle body that the surface currents can efficiently be detected, without any unnecessary projection at the roof rim bar 138.

A magnetic flux induced by the surface currents on the marginal edge 138*a* of the roof rim bar 138 may very efficiently and positively be caught by the loop antenna 12 within the shielding case 10. Furthermore, the loop antenna can positively be protected from any external waves resulting in noise by the shielding case 10. This increases the sensitivity of the loop antenna 12 with respect to the surface currents on the vehicle body.

The elctrostatic shielding case 10 also contains a circuit section 142 connected with the loop antenna 12. Detected currents are matched and amplified by the circuit section 142. The matched and amplified signals are then fetched from the circuit section 142 at a connector 144 such as a BNC connector and transmitted to various built-in receivers through a coaxial cable 18 via a voltage amplifier and others.

In accordance with the present invention, the automobile antenna system for electromagnetically detecting the surface currents flowing on the metallic vehicle plate can very efficiently and positively receive radio waves without being exposed externally in the vehicle body.

Although the present invention has been described as to the automobile antenna system mounted in the roof rim bar, the antenna system may be mounted in any other vehicle location such as the engine hood, trunk lid and others.

In this connection, the automobile antenna system according to the present invention is preferably mounted on the vehicle body at one of the marginal portions on which the surface currents flow concentrically.

We claim:

1. An automobile antenna system for detecting surface currents induced on a vehicle body by broadcast waves, said system comprising:

electrostatic shielding case means mounted on the vehicle body and having an opening formed therein to be opposed to an edge portion of a metallic plate forming the vehicle body; and high-frequency pickup means for detecting the surface currents induced on the vehicle body and including a rectangular loop antenna housed within said electrostatic shielding case means and positioned in close proximity to said opening, said loop antenna including a plane of the loop arranged relative to the surface of said metallic plate of said vehicle body at an angle in the range of 90 degrees to 135 degrees or 225 degrees to 270 degrees.

2. An automobile antenna system as defined in claim 1 wherein the plane of the loop in said loop antenna is inclined relative to the surface of said metallic vehicle plate at an angle in the range of 90 degrees to 135 degrees or 225 degrees to 270 degrees.

3. An automobile antenna system as defined in claim 1 wherein the edge portion of said metallic vehicle plate is turned toward the plane of the loop in said loop antenna at an angle in the range of 90 degrees to 135 degrees or 225 degrees to 270 degrees.

4. An automobile antenna system as defined in claim 3 wherein said antenna system is arranged such that said loop antenna is positioned in close proximity to the marginal edge of a roof rim bar opposite to a window glass.

5. An automobile antenna system as defined in claim 4 wherein said opening is formed in said electrostatic shielding case such that one longer side of said loop antenna can externally be exposed through said opening, the exposed portion of said loop antenna being positioned in close proximity to the marginal edge of said roof rim bar.

6. An automobile antenna system as defined in claim 5 wherein the marginal edge of said roof rim bar is turned against the plane of the loop in said loop antenna at an angle substantially equal to 135 degrees.

7. An automobile antenna system as defined in claim 3 wherein said electrostatic shielding case is mounted on the vehicle body through an adjustable bracket.

8. An automobile antenna system as defined in claim 3 wherein said antenna system is mounted on the vehicle body or metallic closure at its marginal location on which the surface currents induced by radio waves flow concentratedly.

9. An automobile antenna system as defined in claim 1 wherein said electrostatic shielding case is disposed with the metallic vehicle plate facing said opening such that said loop antenna faces said metallic vehicle plate.

10. An automobile antenna system as defined in claim 9 wherein said opening is formed in said electrostatic shielding case such that one longer side of said loop antenna can externally be exposed through said opening, the exposed portion of said loop antenna being positioned in close proximity to the edge of said metallic vehicle plate.

11. An automobile antenna system as defined in claim 10 wherein said loop antenna is angularly disposed relative to said metallic vehicle plate at an angle equal to 225 degrees.

12. An automobile antenna system as defined in claim 1 wherein said antenna system is mounted on any one of a roof rim bar, an engine hood and a trunk lid.

* * * * *